US011376176B2

(12) United States Patent
Enai

(10) Patent No.: US 11,376,176 B2
(45) Date of Patent: Jul. 5, 2022

(54) NURSING BED

(71) Applicant: YUASA KIKAI Inc., Takatsuki (JP)

(72) Inventor: Katsuo Enai, Takatsuki (JP)

(73) Assignee: YUASA KIKAI INC., Takatsuki (JP)

( * ) Notice: Subject to any disclaimer, the term of this patent is extended or adjusted under 35 U.S.C. 154(b) by 0 days.

(21) Appl. No.: 17/434,533

(22) PCT Filed: Mar. 2, 2020

(86) PCT No.: PCT/JP2020/008647

§ 371 (c)(1),
(2) Date: Aug. 27, 2021

(87) PCT Pub. No.: WO2020/184250

PCT Pub. Date: Sep. 17, 2020

(65) Prior Publication Data

US 2022/0096297 A1 Mar. 31, 2022

(30) Foreign Application Priority Data

Mar. 8, 2019 (JP) ..... JP2019-042471

(51) Int. Cl.
*A61G 7/012* (2006.01)
*A61G 7/08* (2006.01)

(52) U.S. Cl.
CPC ..... *A61G 7/012* (2013.01); *A61G 7/08* (2013.01)

(58) Field of Classification Search
CPC ..... A61G 7/00; A61G 7/012; A61G 7/08
See application file for complete search history.

(56) References Cited

U.S. PATENT DOCUMENTS 2,604,639 A * 7/1952 Killifer ..... A61G 7/012 5/614
4,097,941 A * 7/1978 Merkel ..... A61G 1/0231 108/147.22
5,555,582 A * 9/1996 Jerideau ..... A61G 7/00 5/613

(Continued)

FOREIGN PATENT DOCUMENTS

JP S6212324 U 1/1987
JP H05245178 A 9/1993
JP H11033002 A 2/1999

(Continued)

*Primary Examiner* — Fredrick C Conley
(74) *Attorney, Agent, or Firm* — Alleman Hall Creasman & Tuttle LLP

(57) ABSTRACT

The present disclosure provides a nursing bed capable of reducing or preventing occurrence of lumbago of a care worker during a care work. The nursing bed includes a frame part having wheels, a bed part disposed within the frame part, and an elevator. A bed body which is a core part of the bed part has four wheels provided on a back surface opposing to a floor surface. The elevator lowers the bed body in a second direction according to a command from a remote control until the wheels of the bed body are loosely fitted in slots of two rails disposed on the floor surface, and contact the floor surface. Then, the bed part slides along the floor surface to outside of the nursing bed. Moreover, the elevator raises the bed body upwardly from the floor surface in the second direction according to the command from the remote control.

1 Claim, 5 Drawing Sheets

(56) References Cited

U.S. PATENT DOCUMENTS

2001/0029629 A1* 10/2001 Tsuji ..... A61G 5/125
5/618

FOREIGN PATENT DOCUMENTS

| | | | |
|---|---|---|---|
| JP | 2000271171 | A | 10/2000 |
| JP | 2003299699 | A | 10/2003 |
| JP | 2005095251 | A | 4/2005 |
| JP | 2008272400 | A | 11/2008 |
| JP | 2009279361 | A | 12/2009 |
| JP | 2014018623 | A | 2/2014 |
| JP | 2016030148 | A | 3/2016 |

* cited by examiner

NURSING BED

TECHNICAL FIELD

The present disclosure relates to a nursing bed having a movable bed body.

BACKGROUND ART

Conventionally, various movable nursing beds are proposed (see Patent Documents 1-6).

REFERENCE DOCUMENTS OF CONVENTIONAL ART

Patent Documents

Patent Document 1: JP2000-271171A
Patent Document 2: JP1993-245178A
Patent Document 3: JP1999-033002A
Patent Document 4: JP2008-272400A
Patent Document 5: JP2009-279361A
Patent Document 6: JP2014-018623A

DESCRIPTION OF THE DISCLOSURE

Problem to be Solved by the Disclosure

When a care worker lifts a care receiver, such as an elderly person or a sick person, in his/her arms from a nursing bed, and transfers the care receiver to a wheelchair etc., the care worker has to perform this work while squatting. Therefore, the care worker is bothered by lumbago or (low) back pain. This trouble also occurs similarly in returning the care receiver to the nursing bed from the wheelchair etc.

Purpose of the Disclosure

The present disclosure is made in view of such a trouble, and a main purpose thereof is to provide a nursing bed capable of avoiding lumbago of a care worker, even when the care worker often transfers a care receiver to a wheelchair etc. from a nursing bed, and vice versa.

Summary of the Disclosure

A nursing bed according to the subject-matter of the present disclosure comprises a frame part forming a frame of the nursing bed and including a bottom part where a plurality of second wheels are disposed, the second wheels always contacting a floor surface during use and being rotatable and movable on the floor surface, a bed body forming a base bottom part of a bed part disposed above the floor surface within the frame part in the floor surface in a top view when a care receiver lies thereon, and including a first wheel on a back surface opposing to the floor surface within the frame part, and an elevator configured to support the bed body and lower the bed body until the first wheel of the bed body located above the floor surface within the frame part contacts the floor surface within the frame part. When the bed body where the care receiver lies is lowered by a drive of the elevator and the first wheel contacts the floor surface within the frame part, the elevator cancels the support of the bed body to separate the bed body from the frame part. The bed body translates, according to the rotation of the first wheel outwardly in a short-side direction of the bed body, from a position above the floor surface within the frame part to a position above the floor surface that is one of outside positions of the frame part in the short-side direction of the bed body. While the entirety of the bed body is lowered and translated to the one of outside positions of the frame part, the plurality of second wheels of the frame part and the frame part are in a stopped state.

Effect of the Disclosure

The nursing bed according to the subject-matter of the present disclosure can suppress or prevent occurrence of a situation where a care worker is bothered by the lumbago during a care work.

Hereinafter, various embodiments of the present disclosure are described in detail with reference to the accompanying drawings, together with effects and advantages thereof.

MODE FOR CARRYING OUT THE DISCLOSURE

Embodiment 1

<Outline of Features of Nursing Bed>

A "bed body" which is a substantial part of a nursing bed according to this embodiment has a function in which it is movable vertically with respect to a floor surface, and it is slidable or translatable to outside the nursing bed along the floor surface after it is lowered to the floor surface from above. Therefore, the nursing bed includes (1) a bed body having four wheels on a back surface opposing to the floor surface, (2) an elevator which can lower the bed body until the four wheels of the bed body located above the floor surface contacts the floor surface and can raise the bed body upwardly from the floor surface. Below, a configuration and functions of the nursing bed are described.

<Configuration of Nursing Bed>

Figure 1:
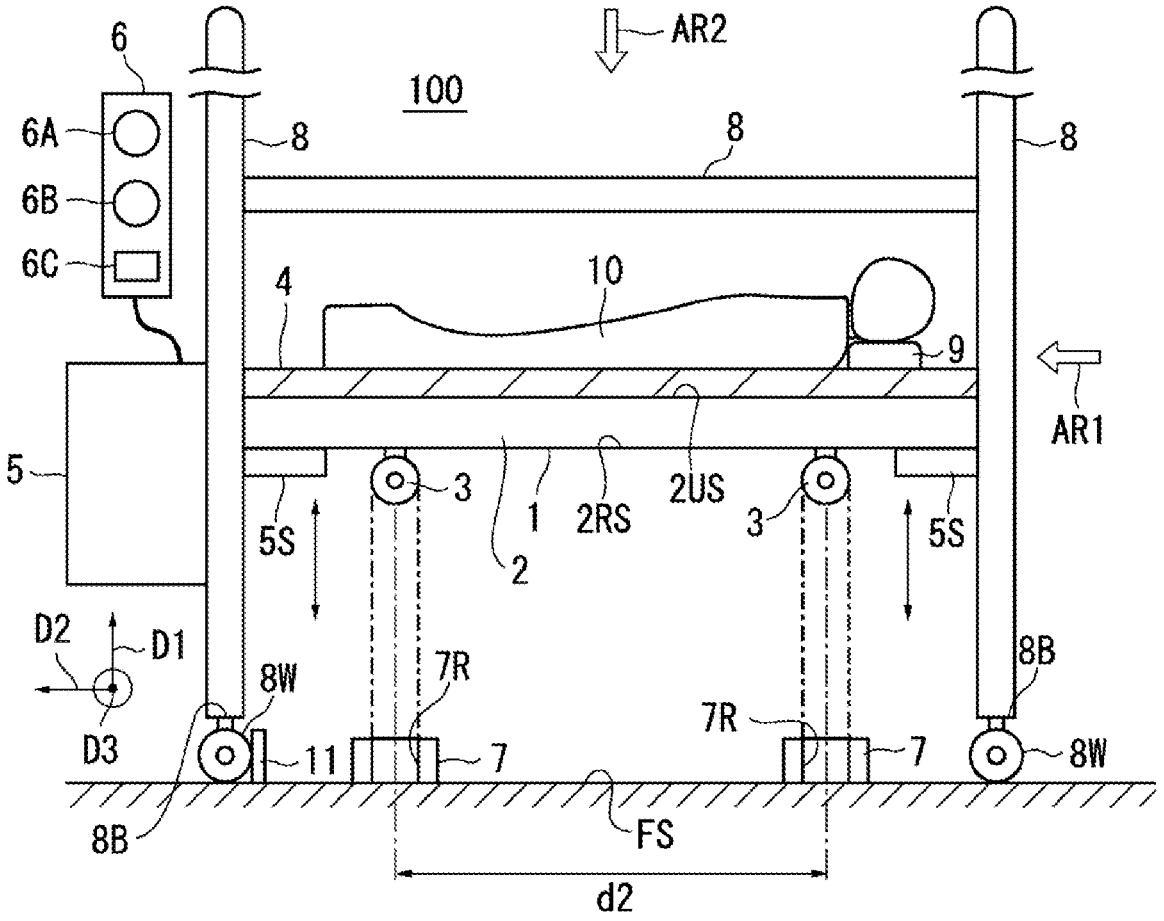
FIG. 1 is an elevational view schematically illustrating a configuration of a nursing bed according to Embodiment 1 of the present disclosure.
Figure 2:
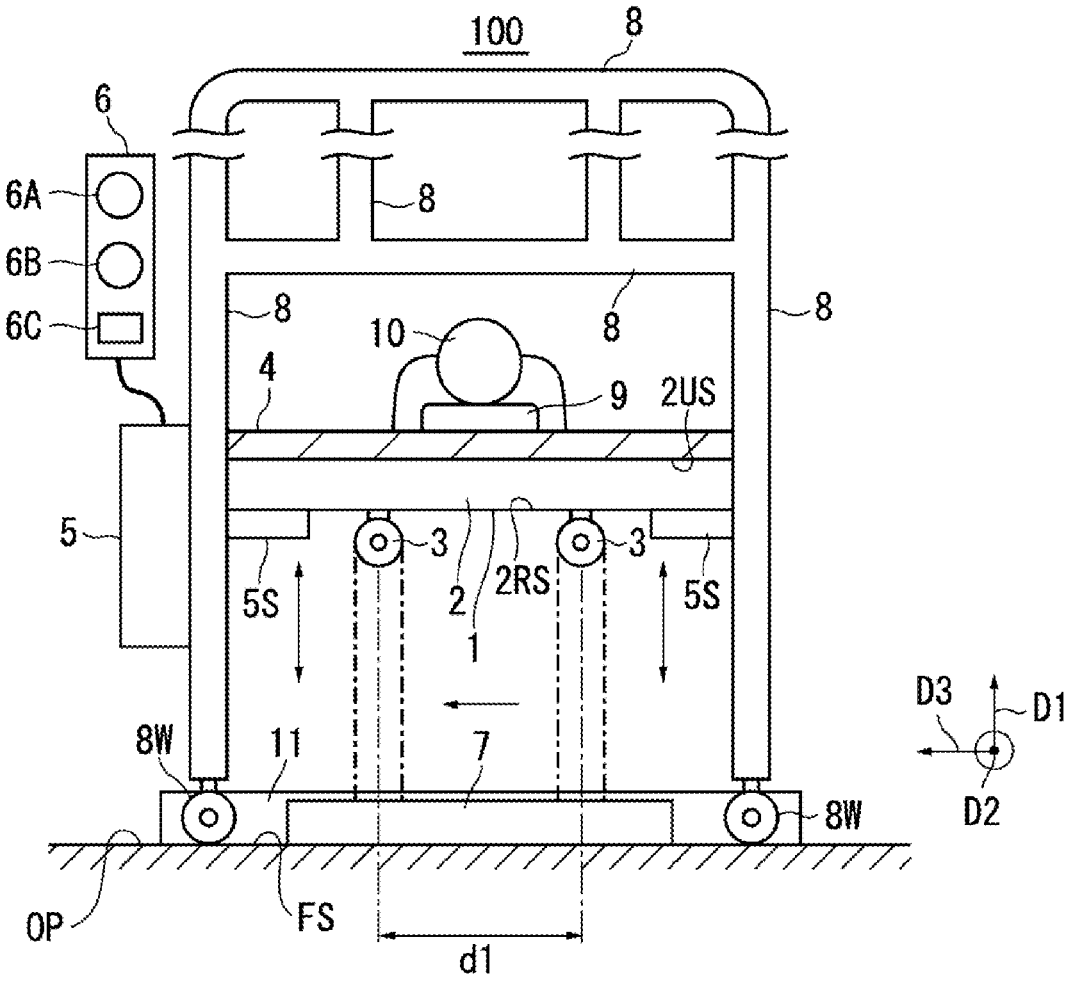
FIG. 2 is a side view schematically illustrating the configuration of the nursing bed according to Embodiment 1 of the present disclosure.
Figure 3:
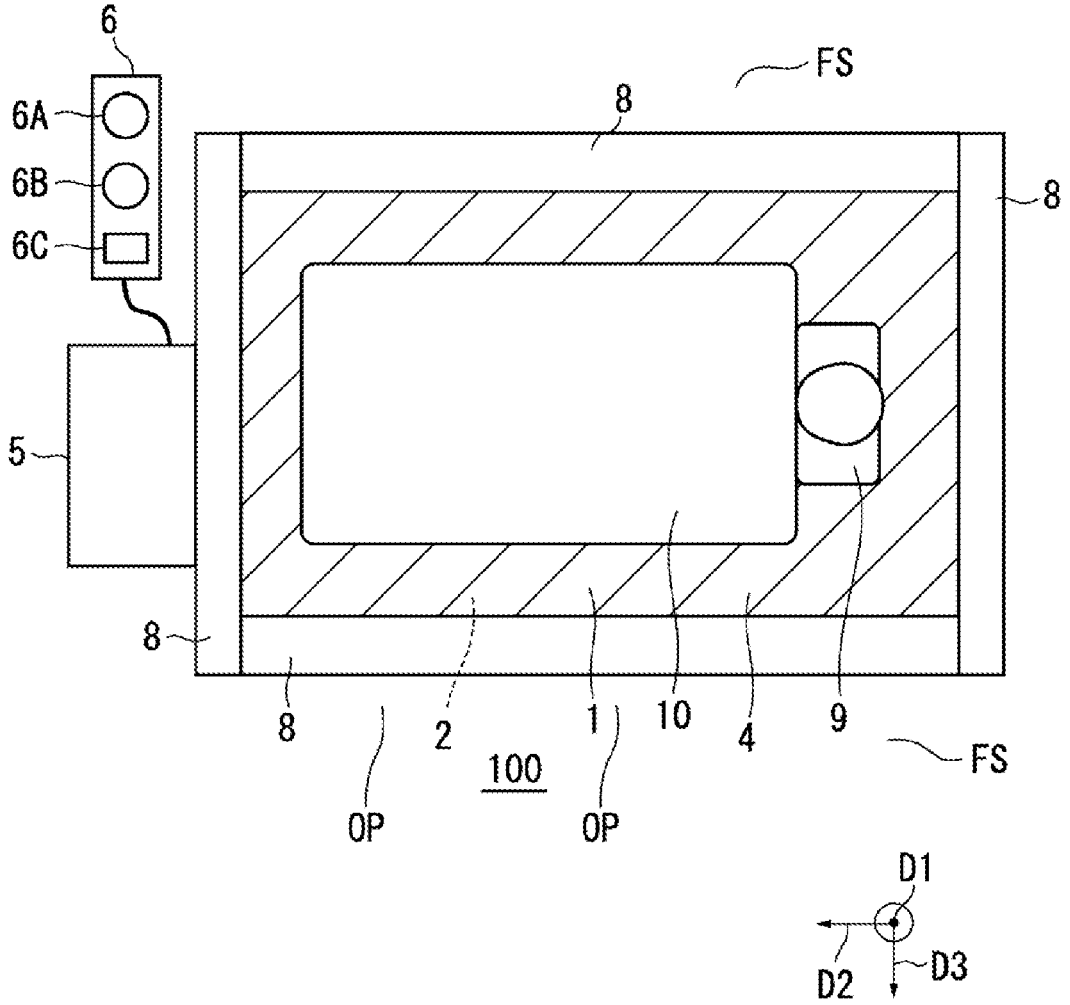
FIG. 3 is a top view schematically illustrating the configuration of the nursing bed according to Embodiment 1 of the present disclosure.

FIG. 1 is an elevational view schematically illustrating the configuration of a nursing bed 100 according to this embodiment. Further, FIG. 2 is a side view schematically illustrating the configuration of the nursing bed 100, when viewing the nursing bed 100 of FIG. 1 in an arrow AR1 direction of FIG. 1. Further, FIG. 3 is a top view schematically illustrating the configuration of the nursing bed 100, when viewing the nursing bed 100 of FIG. 1 in an arrow AR2 direction. In FIGS. 1 to 3, a first direction D1 is a vertical direction perpendicular to a floor surface FS, and a second direction D2 and a third direction D3 are directions perpendicular to each other in a plane parallel to the floor surface FS. Among those, the second direction D2 corresponds to a long-side direction of the nursing bed 100 or the bed body, and the third direction D3 corresponds to a short-side direction of the nursing bed 100 or the bed body.

The nursing bed 100 has a frame part 8 which forms a frame of the nursing bed as one of the substantial parts thereof. The frame part 8 has bottom parts 8B where four wheels (second wheels) 8W, which always contact the floor surface FS during use and are rotatable and movable on the floor surface FS, are disposed. Among these wheels 8W, two wheels 8W opposing to each other in the third direction D3 contact a wheel stopping plate 11 disposed on the floor surface FS and are stopped thereby. By the stop operation of the wheels 8W, the frame part 8 itself is also stopped with respect to the floor surface FS.

In addition, the nursing bed 100 includes, as one of the substantial parts, a bed part 1 disposed, within the frame part 8, at a position above the floor surface FS, when a care receiver 10, such as a patient or a sick person, lays down using a pillow 9 under his/her head. The bed part 1 is generally comprised of a bed body 2 which forms a skeleton part or base bottom part thereof, and a mat 4 provided onto a flat surface (upper surface) 2US of the bed body 2. Note that, in each of the drawings of FIGS. 1 to 3, the mat 4 is illustrated as being hatched, in terms of the clarification of illustration. As an especially-noted feature, here, the bed body 2 has four wheels 3 disposed on a flat back surface (lower surface) 2RS which parallelly opposes to the floor surface FS. Among the four wheels 3, two wheels 3 which are disposed so as to oppose to each other in the third direction D3 with a given first distance d1 therebetween and the remaining two wheels 3 which are disposed so as to oppose to each other in the third direction D3 with the given first distance d1 therebetween are disposed so as to oppose to each other in the second direction D2 with a given second distance d2 therebetween. Each of the wheels 3 is pivotable by 360° around its axis of rotation. As will be described later, after each wheel 3 contacts the floor surface FS, the bed body 2 is slidable or translatable on the floor surface FS in the third direction D3 according to the rotation of the wheels 3 outwardly in the third direction D3, to an outward position OP (see FIG. 3) of the nursing bed 100.

Further, the nursing bed 100 includes, as one of the substantial parts, an elevator 5 of which operation is controlled by a command signal from a remote controller (hereinafter, referred to as "the remote control") 6. The elevator 5 has four supports 5S movable in the second direction D2. The supports 5S project from four corners of the back surface 2RS of the bed body 2 to their peripheries, and support the bed body 2 while contacting the back surface 2RS. That is, (1) while a care worker pushes a first button 6A of the remote control 6, the elevator 5 raises the bed body 2 upwardly in the first direction D1 by driving the supports 5S upwardly, and (2) while the care worker pushes a second button 6B of the remote control 6, the elevator 5 lowers the bed body 2 downwardly in the first direction D1 by driving the supports 5S downwardly. Then, (3) when the care worker pushes a third button 6C of the remote control 6 after the wheels 3 of the bed body 2 contact the floor surface FS, the elevator 5 translates the supports 5S, which are in contact with the back surface 2RS of the bed body 2, outwardly in the second direction D2 to separate and retreat the supports 5S from the back surface 2RS of the bed body 2. Note that the communication between the remote control 6 and the elevator 5 may be performed wiredly or wirelessly.

Moreover, the nursing bed 100 is further provided with, as one of the systems, two rails 7 which are laid on the floor surface FS so as to be parallel to each other. That is, each rail 7 is laid in the third direction D3, on a part of the floor surface FS directly below the bed body 2. Further, each rail 7 has a penetrated slot 7R which extends in the third direction D3, where one end part of the rail 7 on the outward position OP side of the floor surface FS is opened, and the other end part is closed. That is, each rail 7 is laid on a suitable positional part of the floor surface FS so that, when the frame part 8 is in a stopped state by the wheel stopping plate 11, the wheels 3 of the bed body 2 which are lowered by the operation of the elevator 5 fit in the corresponding slot 7R with some play (loosely-fitting state) when the wheels 3 contact the floor surface FS. Therefore, the wheels 3 which are loosely fitted in the slot 7R of each rail 7 translate or slide toward the outward position OP along the slot 7R of the rail 7 in response to the operation of the bed body 2 being pulled out toward the outward position OP of the floor surface FS.

<Operation, Functions, and Advantages of Nursing Bed>

By the adoption of the nursing bed 100 having the configuration described already, operation, functions, and advantages which are listed below can be acquired.

First, suppose that a care receiver goes to another place, such as a toilet, a bathroom, or an examination room, from a state where the care receiver lies on the bed part 1 of the nursing bed 100 (the state illustrated in FIGS. 1 to 3).

Figure 4:
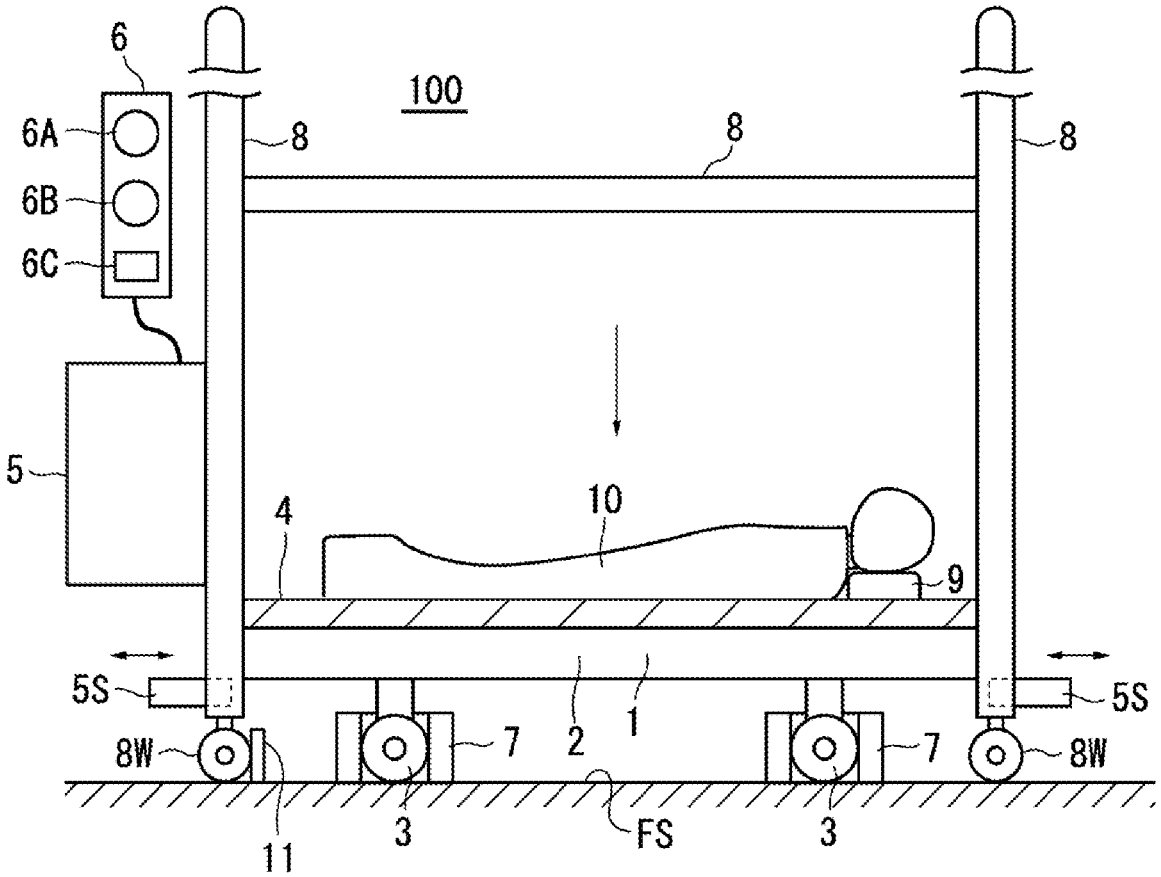
FIG. 4 is a view schematically illustrating a function of the nursing bed according to Embodiment 1 of the present disclosure.

A care worker pushes the second button 6B of the remote control 6 to cause the elevator 5 to drive so that the elevator 5 lowers the bed part 1 or the bed body 2 in the first direction D1 toward the floor surface FS. As a result, the bed part 1 continues descending toward the floor surface FS while carrying the care receiver, and the wheels 3 of the bed body 2 loosely fit into the slot 7R of the corresponding rail 7 and then contact the floor surface FS. When the elevator 5 detects this contact state, it suspends the descending motion of the supports 5S, and therefore, the bed part 1 or the bed body 2 is placed on the floor surface FS in the stopped state. Further, the care worker pushes the third button 6C of the remote control 6, and in response to this, the elevator 5 moves and retreats the supports 5S in the second direction D2 rearwardly. FIG. 4 is an elevational view schematically illustrating the stopped state of the bed part 1 or the bed body 2. As illustrated in FIG. 4, the wheels 3 of the bed body 2 contact and stop on the floor surface FS in the loosely-fitted state in the slot 7R of the corresponding rail 7, and the wheels 8W of the frame part 8 also contact and stop on the floor surface FS.

Figure 5A:
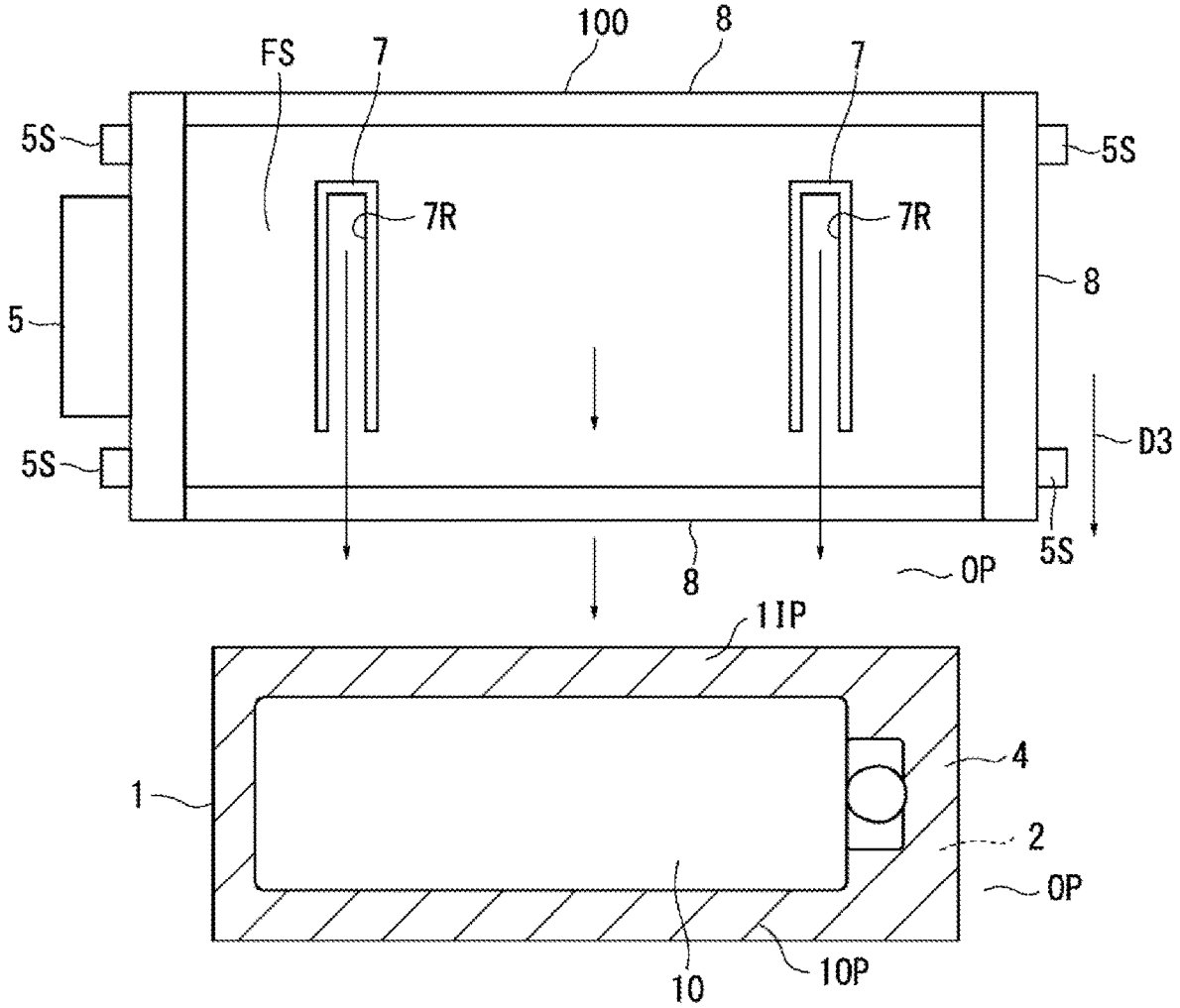
FIG. 5(*a*) and FIG. 5(*b*) are views schematically illustrating a function of the nursing bed according to Embodiment 1 of the present disclosure.
Figure 5B:
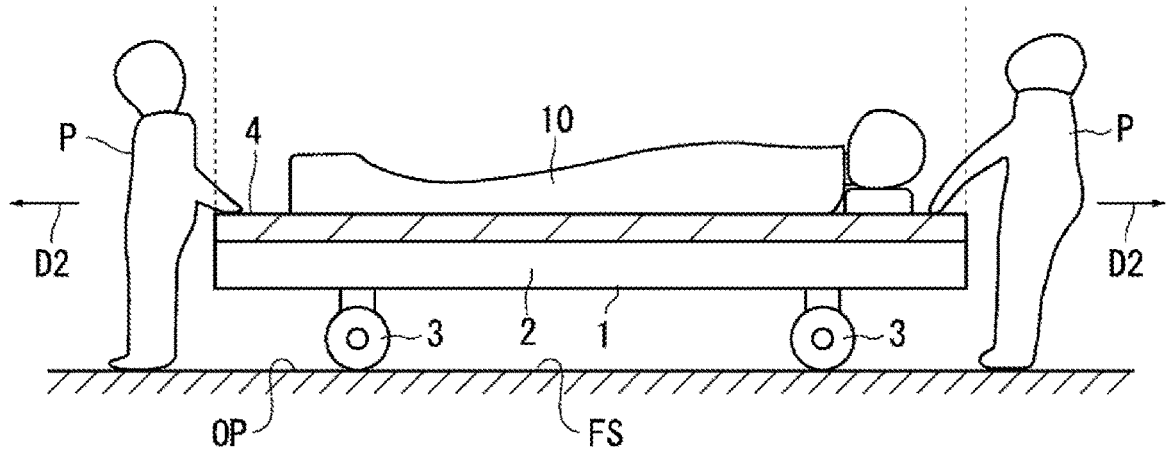

Next, as illustrated in the top view of FIG. 5(*a*), the care worker grabs an outer long-side part 1OP of the bed part 1 by hands, and pulls out the bed part 1, where the care receiver 10 lies, in the third direction D3 toward the outward position OP of the floor surface FS. In response to this drawing-out operation, the wheels 3 of the bed body 2 rotate on the floor surface FS in the slot 7R of the corresponding rail 7 toward the outward position OP of the floor surface FS in the extending direction of the slot 7R (third direction D3), while being guided by the slot 7R of the rail 7 so that the wheels 3 slide or translate with respect to the floor surface FS. In this case, the care worker continues performing the drawing-out operation or the sliding operation of the bed part 1 until an inner long-side part 1IP of the bed part 1 reaches the outward position OP of the floor surface FS. As illustrated in FIG. 5(*a*), by the completion of the drawing-out operation by the care worker, the entire bed part 1 where the care receiver 10 lies, is pulled out to the outside part of the nursing bed 100 and is located at the outward position OP of the floor surface FS.

In the state illustrated in FIGS. 5(*a*) and 5(*b*), the height of the bed part 1 from the floor surface FS is sufficiently lower than the height of the bed part 1 from the floor surface FS before the start of the descending illustrated in FIG. 1. Therefore, the care worker P is able to transfer the lying care receiver 10 to a wheelchair by holding in his/her arms while straightening his/her back and kneeling down on the floor surface FS, without in a half-sitting state where he/she is squatting while bending the back. Therefore, the care worker P is able to provide a nursing service to the care receiver laying on the bed part 1, without being bothered by the lumbago which may occur because of the care operation. In other words, the nursing bed 100 having the bed body 2 which is elevatable and slidable can suppress or prevent the occurrence of the lumbago of the care worker P during the care work. Alternatively, as illustrated in FIG. 5(*b*), the care worker P moves the bed part 1 in the second direction D2, which is pulled out to the outward position OP of the floor surface FS by the slide movement or the translation of the bed part 1, to easily transfer the bed part 1 where the care receiver 10 lies to other places. Also in this case, the care worker P is able to move the care receiver 10 who lies on the bed part 1 to other places, while maintaining the posture and the state of the care receiver 10 as they are, without being bothered by the occurrence of the lumbago. Also, after moving to the other places (e.g., the bathroom or the toilet), as described already, the care worker P is able to make the care receiver 10 sit up from the bed part 1 while straightening his/her back and kneeling down on the floor surface etc., and provide a given nursing service to the care receiver 10 while reducing and suppressing the burden to the waist or the back.

Note that, when resuming the bed part 1 to the state illustrated in FIG. 1, the reverse operation of the operation described already is performed to the bed part 1, after the bed part 1 is returned from other places to the location of the nursing bed 100 carrying the care receiver, or after the care receiver is transferred from the wheelchair to the bed part 1 located by the nursing bed 100. That is, the care worker P first sets the bed part 1 by performing the slide movement or the translation in which the bed part 1 is pushed into the nursing bed 100 in the reverse direction of the third direction D3, and pushes the third button 6C of the remote control 6 to carry out the forward translation of the supports 5S by the elevator 5, and therefore, the bed part 1 is supported by the contact to the supports 5S. Further, the care worker P pushes the first button 6A of the remote control 6 to resume the bed part 1 where the care receiver lies to the initial state illustrated in FIG. 1 by the elevating motion of the elevator 5. Also in this case, the care worker P is able to complete the series of care works, without the burden to his/her waist or back, or without being bothered by the lumbago.

(Modifications)

(1) In Embodiment 1, although the bed body 2 has the four wheels 3 as a typical example, the number of wheels 3 disposed on the back surface 2RS of the bed body 2 is at least one. Further, the disposed positions of the wheels 3 on the back surface 2RS of the bed body 2 are arbitrary positions, and the first distance d1 and the second distance d2 are set suitably. Further, the mat 4 is an optional element as the component of the bed part 1.

(2) Although the two rails 7 where the wheels 3 of the bed body 2 are loosely fitted in the slots 7R are adopted in Embodiment 1, the number of rails 7 may be one. Alternatively, no rail 7 laid on the floor surface FS may be provided.

(3) Among the functions and operation of the elevator 5 adopted in Embodiment 1, the function and operation of the rearward or retreat movement of the supports 5S in the second direction D2 realized by the third button 6C of the remote control 6 may not be adopted.

(4) The bed part 1 or the bed body 2 in Embodiment 1 may have, in addition to the functions described already, a "reclining" function in which an inclination angle of a part of the bed body 2 on the head side of the care receiver and/or an inclination angle of a foot-side part may be changed according to the operation of the remote control.

ADDITIONAL REMARKS

As described above, although the embodiment of the present disclosure is disclosed and described in detail, the above description is intended to illustrate an aspect to which the present disclosure may be applied, and therefore, the present disclosure is not limited to the configuration. That is, it is possible to consider various corrections and/or modifications over the above-described aspect without departing from the scope of the present disclosure.

INDUSTRIAL APPLICABILITY

The present disclosure is suitable to be applied to a vertical movement type nursing bed, for example.

DESCRIPTION OF REFERENCE CHARACTERS

100 Nursing Bed
1 Bed Part
2 Bed Body
2RS Back Surface of Bed Body
3 Wheel of Bed Body (First Wheel)
4 Mat
5 Elevator
6 Remote Controller (Remote Control)
7 Rail
7R Slot of Rail
8 Frame Part
8W Wheel of Frame Part (Second Wheel)
FS Floor Surface

What is claimed is:

1. A nursing bed, comprising:

a frame part forming a frame of the nursing bed and including a bottom part where a plurality of second wheels are disposed, the second wheels always contacting a floor surface during use and being rotatable and movable on the floor surface;

a bed body forming a base bottom part of a bed part disposed above the floor surface within the frame part in the floor surface in a top view when a care receiver lies thereon, and including a first wheel on a back surface opposing to the floor surface within the frame part;

an elevator configured to support the bed body and lower the bed body until the first wheel of the bed body located above the floor surface within the frame part contacts the floor surface within the frame part; and a rail laid on a part of the floor surface directly below the bed body in a short-side direction of the bed body, and including a penetrating slot extending in the short-side direction, wherein when the bed body where the care receiver lies is lowered by a drive of the elevator and the first wheel contacts the floor surface within the frame part, the elevator cancels the support of the bed body to separate the bed body from the frame part, the bed body translates, according to the rotation of the first wheel outwardly in the short-side direction of the bed body, from a position above the floor surface within the frame part to a position above the floor surface that is one of outside positions of the frame part in the short-side direction of the bed body, while the entirety of the bed body is lowered and translated to the one of outside positions of the frame part, the plurality of second wheels of the frame part and the frame part are in a stopped state, and the first wheel is fitted in the penetrating slot when the first wheel of the lowered bed body contacts the floor surface.

* * * * *